United States Patent [19]

Redwine et al.

[11] Patent Number: 4,527,961

[45] Date of Patent: Jul. 9, 1985

[54] RECIPROCABLE PUMP HAVING AXIALLY PIVOTABLE MANIFOLD TO FACILITATE VALVE INSPECTION

[75] Inventors: Fletcher H. Redwine, Garland; James E. Thompson, Richardson, both of Tex.

[73] Assignee: United States Steel Corporation, Pittsburgh, Pa.

[21] Appl. No.: 584,209

[22] Filed: Feb. 27, 1984

Related U.S. Application Data

[62] Division of Ser. No. 411,932, Aug. 26, 1982, Pat. No. 4,467,703.

[51] Int. Cl.[3] ..... F04B 39/14; F04B 21/02

[52] U.S. Cl. ..... 417/454; 417/568; 92/128; 137/454.4

[58] Field of Search ..... 417/437, 454, 539, 559, 417/568-571; 92/128; 137/454.4, 542

[56] References Cited

U.S. PATENT DOCUMENTS

| | | | |
|---|---|---|---|
| 1,014,153 | 1/1912 | Jennings | 417/458 X |
| 1,273,229 | 7/1918 | Hurlbrink | 123/188 B |
| 1,364,508 | 1/1921 | Moody | 91/499 |
| 1,565,819 | 12/1925 | Saunders | 417/454 X |
| 1,650,377 | 11/1927 | Nixon | 417/571 X |
| 1,798,227 | 3/1931 | Schaer | 417/559 |
| 1,993,664 | 3/1935 | Hirsch | 417/454 |
| 2,092,641 | 9/1937 | Doran | 417/571 X |
| 2,250,164 | 7/1941 | Mirder | 417/571 |
| 2,625,016 | 1/1953 | St. Clair | 137/542 X |
| 2,733,664 | 2/1956 | Saalfrank | 92/128 X |
| 2,962,974 | 12/1960 | Porkert | 417/571 |
| 3,049,082 | 8/1962 | Barry | 417/559 X |
| 3,373,695 | 3/1968 | Yohpe | 417/569 |
| 3,639,086 | 2/1972 | Robbins | 417/454 |
| 3,801,234 | 4/1974 | Love et al. | 417/454 |
| 4,008,012 | 2/1977 | Page | 417/454 |
| 4,239,463 | 12/1980 | Yaindl | 417/539 X |
| 4,456,440 | 6/1984 | Korner | 417/568 X |

FOREIGN PATENT DOCUMENTS

| | | | |
|---|---|---|---|
| 843734 | 7/1952 | Fed. Rep. of Germany | 417/521 |
| 1453611 | 2/1969 | Fed. Rep. of Germany | 417/539 |
| 882886 | 3/1943 | France | 417/559 |

*Primary Examiner*—William L. Freeh
*Assistant Examiner*—Paul F. Neils
*Attorney, Agent, or Firm*—William F. Riesmeyer, III

[57] ABSTRACT

The present invention involves improvements in reciprocable pumps. In one aspect, applicable to single action pumps, a quick release mounting means is provided for attaching a fluid end piece to a power frame. The frame has a tapered opening for receiving a barrel portion of the fluid end therein. A wedge device of mateable taper with the opening connects the barrel securely to the frame. The wedge extends around the transverse outer periphery of the barrel portion. Another aspect of the invention involves providing axially rotatable intake or exhaust manifolds. In a multiplex pump, the manifold may be rotatable as a unit, or the section for each conduit may be separately rotatable. This feature permits easier handling when making repairs, especially on larger pumps. Finally, in pumps having non-vertical suction or discharge passages, the valve counterbores are tilted toward a vertical direction, but not more than an angle at which straight-line machining of the suction or discharge passage is still possible. The more nearly vertical alignment of the valves reduces wear during service. This feature is especially applicable to fluid ends having suction and discharge passages which are equiangular with respect to a piston or plunger passage.

2 Claims, 7 Drawing Figures

RECIPROCABLE PUMP HAVING AXIALLY PIVOTABLE MANIFOLD TO FACILITATE VALVE INSPECTION

This is a divisional of application Ser. No. 411,932, filed Aug. 26, 1982, now U.S. Pat. No. 4,467,703.

BACKGROUND OF THE INVENTION

This invention relates to improvements in reciprocable pumps, particularly oil well service pumps.

In conventional well service pumps it is difficult to detach the fluid end from the power frame in order to replace it or make repairs. Normally, a close fitting pilot is provided for mounting of the fluid end in properly centered alignment in the frame with respect to the plunger. Threaded fasteners are used to secure the fluid end to the pilot and frame. The pilot and fasteners often become corroded and get stuck. Therefore, detachment of the fluid end may be difficult and time-consuming. Recently, sectional fluid ends have been provided so that, for example, only a plunger bore portion of the fluid end need be changed to replace packing or change pump capacity, an example is shown in U.S. Pat. No. 3,801,234, Love et al. These designs however still utilize threaded fasteners for attaching the parts to the frame thus not alleviating the problems encountered in disassembly.

One of the advantages of sectional designs is that the size of the fluid end body may be reduced, thus decreasing cost. This concept can be carried even further by providing suction and discharge passages which join the plunger passage at equal angles, preferably at 120 degrees with respect thereto so as to minimize stresses. However, this configuration normally requires that the suction and discharge passages be tilted away from a vertical alignment. Thus, valve wear tends to increase.

Another feature of some sectional pumps is that the valve covers may be readily detachable so that repair or replacement is easier. However, in large pumps manual handling of the parts is difficult and perhaps even hazardous.

It is a primary object of this invention to provide various improvements in reciprocable pumps for decreasing the time required for disassembly and replacement or repair, as well as making handling of the parts easier.

It is another object of this invention to decrease valve wear in a fluid end having suction or discharge passages which are displaced from vertical alignment.

SUMMARY OF THE INVENTION

According to one aspect of the invention, a quick-release mounting is provided for attaching a pump fluid end to a power frame. This feature is applicable to any single acting reciprocable type pump, but is especially suited for use on oil well service pumps. The fluid end of the pump has a barrel portion containing a first passage extending longitudinally at least part way therethrough, and a main portion which contains suction and discharge passages adapted to communicate with the first passage in the barrel portion. The power frame has a tapered opening for receiving at least part of the barrel portion longitudinally therein. The frame opening is tapered from a larger to smaller cross-section in the direction of inward strokes of a reciprocable body into the fluid end. The angle of taper of the wall of the frame opening with respect to the axis thereof is within the range of 5 to 25 degrees. Preferably, the angle of taper is within the range of 7 to 18 degrees, most preferably 7 to 12 degrees. Wedge means is provided for connecting the fluid end to the frame. The wedge device extends circumferentially around the transverse outer periphery of the barrel portion of the fluid end. Where the fluid end is of one-piece integral construction, the wedge device is separable from the main portion and preferably is comprised of circumferential segments so as to be more easily installed on the barrel. Where the barrel portion is separable from the main portion of the fluid end, the wedge means may be integral with the barrel portion if desired.

In another aspect of the invention, at least one of the intake and exhaust manifolds are axially rotatable about a fluid tight joint. This feature is particularly advantageous in multiplex pumps, i.e., those having two or more plungers or pistons. The heavy manifold pipes may be handled more easily by rotating them to a storage position while working on the valves. In multiple piston or plunger pumps, the conduit to each intake or exhaust passage may be separately rotatable, or rotatable as a unit with other intake or exhaust conduits.

Finally, another feature of the pump involves providing valves tilted toward a vertical direction in suction or discharge passages which are not vertically aligned. Preferably, the valve counterbores are intentionally tilted toward a vertical direction, preferably a major portion of the maximum angle permitted, while still retaining a straight line machining capability for boring of the suction or discharge passages themselves. This latter feature is particularly advantageous in pump fluid ends having equiangular suction and discharge passages. For example, it is preferred that each passage be spaced 120 degrees from the others. Such fluid ends may be smaller and have less mass since the stresses to which they are subjected are lower. The tilted valve feature permits retention of the above-mentioned advantages while decreasing wear on the valves which normally occurs when they are in a non-vertical attitude.

DESCRIPTION OF THE PREFERRED EMBODIMENT

Figure 1:
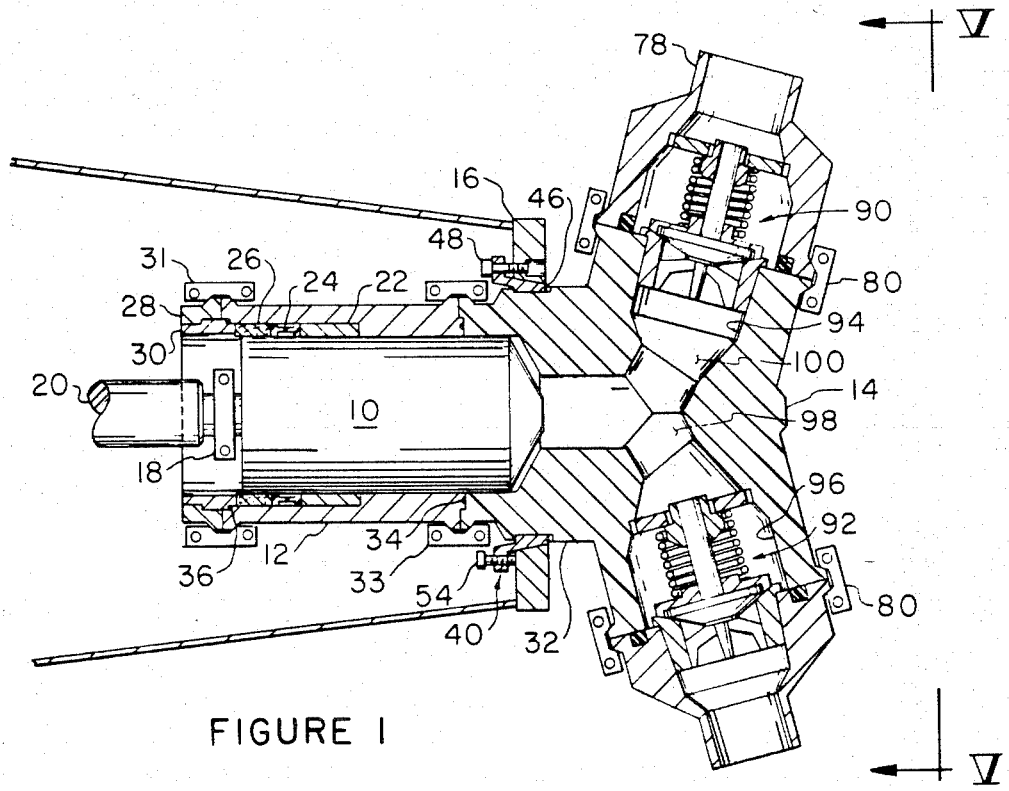
FIG. 1 is a side elevation view in cross section of a pump showing the features of the present invention.

Referring to FIG. 1, the several features of the present invention are illustrated in an oil well service pump which includes plunger 10, stuffing box 12, fluid end 14 and power frame 16. Plunger 10 is attached by a clamp 18 to extension rod 20 which is driven reciprocably by conventional motor means (not shown). The stuffing box includes a bushing 22, lantern ring 24 and packing 26 held in place by packing retainer 28 and follower 30. A two-piece V-ring clamp 31 secures retainer 28 to stuffing box 12. Similarly, another V-ring clamp 33 is used to secure the stuffing box to a barrel portion 32 of the fluid end 14. Rings seals 34, 36 are provided at the joints between the stuffing box and barrel portion and the stuffing box and retainer, respectively.

Figure 2:
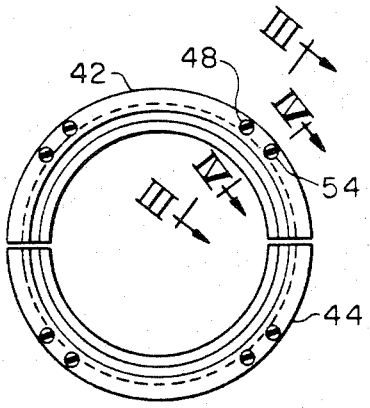
FIG. 2 is an end view of a preferred form of the wedge device for attaching the fluid end to the power frame.
Figure 3:
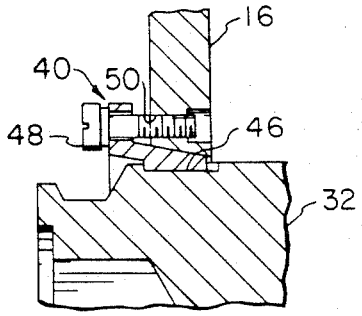
FIG. 3 is a section taken at III—III of FIG. 2.
Figure 4:
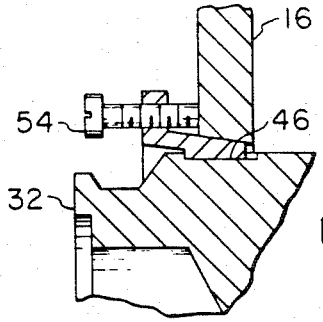
FIG. 4 is a section taken at IV—IV of FIG. 2.

In a first aspect of the present invention, frame 16 has a tapered opening for receipt of the barrel portion 32 of the fluid end therein. A wedge means 40 is provided having an outer wall of mateable taper with the frame opening. The angle of taper is designed so as to prevent loosening of the fluid end in the frame during operation and is dependent on the coefficient of friction of the mated surfaces of the wedge means and frame opening. The wedge means is of two semi-circular peripheral segments 42, 44 (FIG. 2) seated in annular groove 46 (FIG. 1) on the barrel portion. Referring to FIGS. 2, 3 and 4, each segment includes insertion means in the form of threaded bolts 48, each of which engage a threaded hole 50 in the frame. Bolts 48 provide for correct insertion of the segments, thus insuring proper centering and horizontal alignment of the barrel portion 32. Means for exerting withdrawal force is provided in the form of bolts 54 which serve as jackscrews abutting frame 16. Tightening of bolts 54 tends to withdraw the wedge segments from the tapered opening of the frame.

Figure 5:
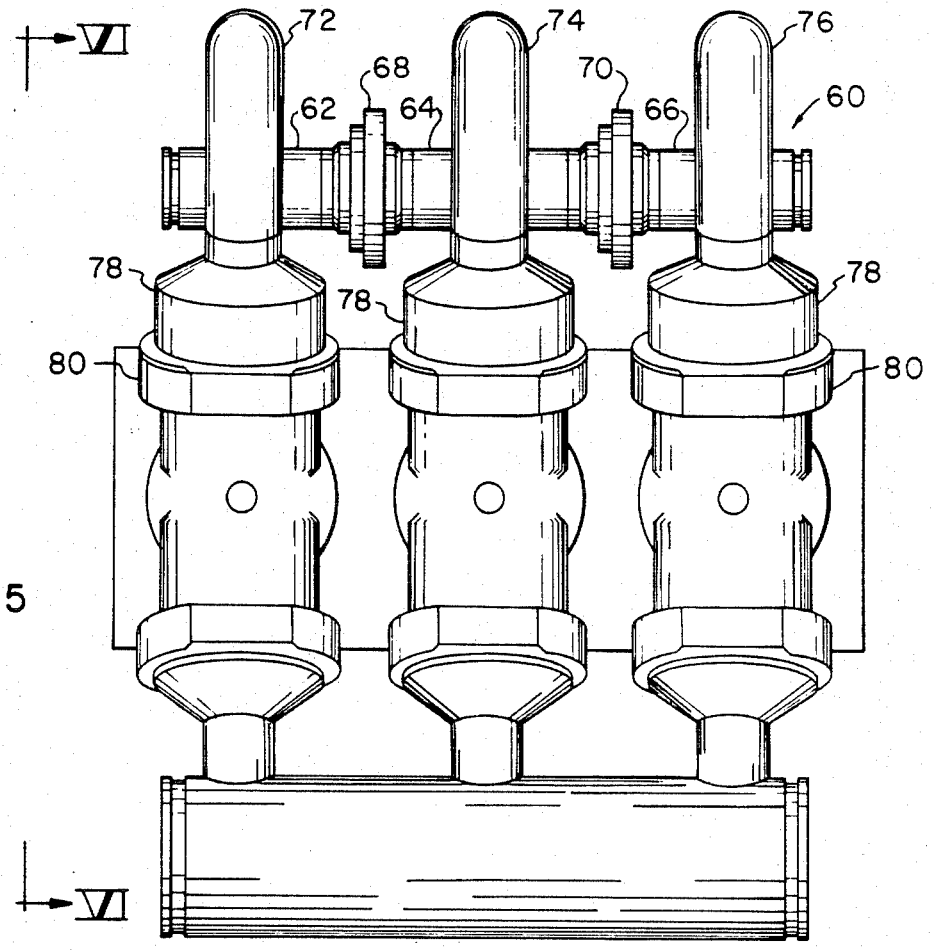
FIG. 5 is an end view taken from V—V of FIG. 2.
Figure 6:
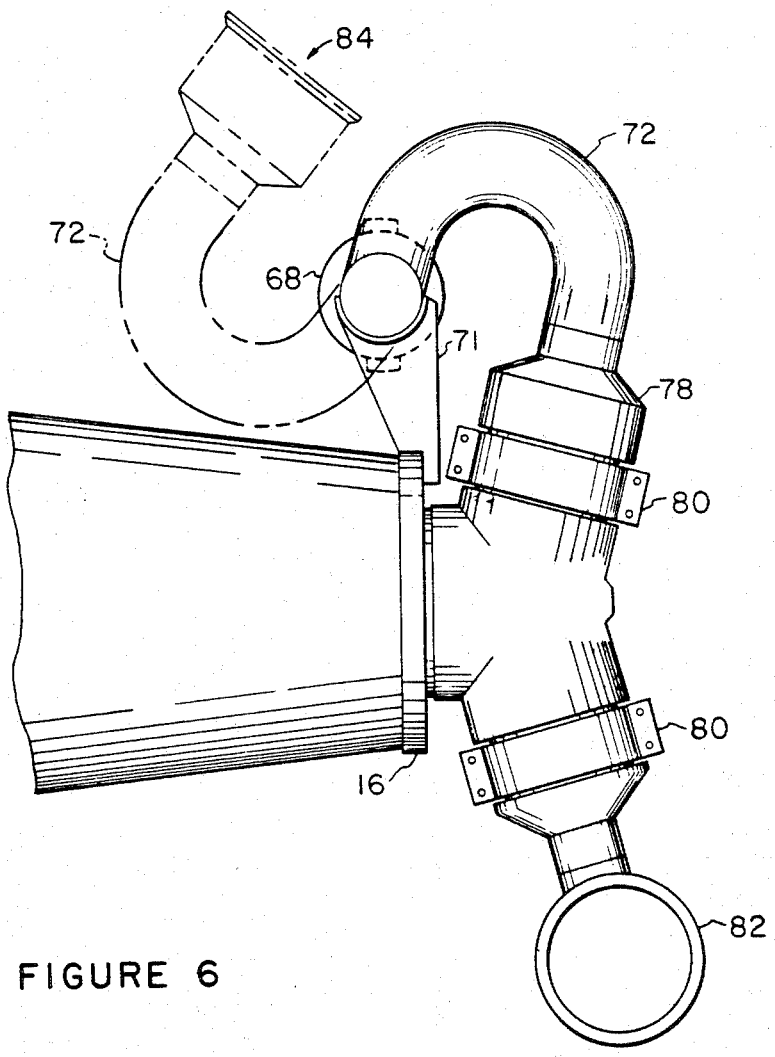
FIG. 6 is a side view taken from VI—VI of FIG. 5.

Referring now to FIGS. 5 and 6, discharge manifold 60 is comprised of a plurality of axially rotatable tubular sections 62, 64 and 66 joined axially by fluid-tight unions 68, 70, which are secured to the power frame 16 by bracket 71 (FIG. 6). There are many commercially available rotatable unions which may be used for this purpose. It may be advantageous to use a type which can be locked securely in position at any of various angular rotations. Also, rotatably driven types may be used. Conduits 72, 74 and 76 each have a valve cover 78 connected to the fluid end by V-ring clamps 80 of the same type mentioned previously. It will be apparent that the suction manifold 82 may be provided with the same axially rotatable feature if desired. FIG. 6 shows conduit 72 rotated to its storage position 84 when it is desired to work on the pump valves.

Figure 7:
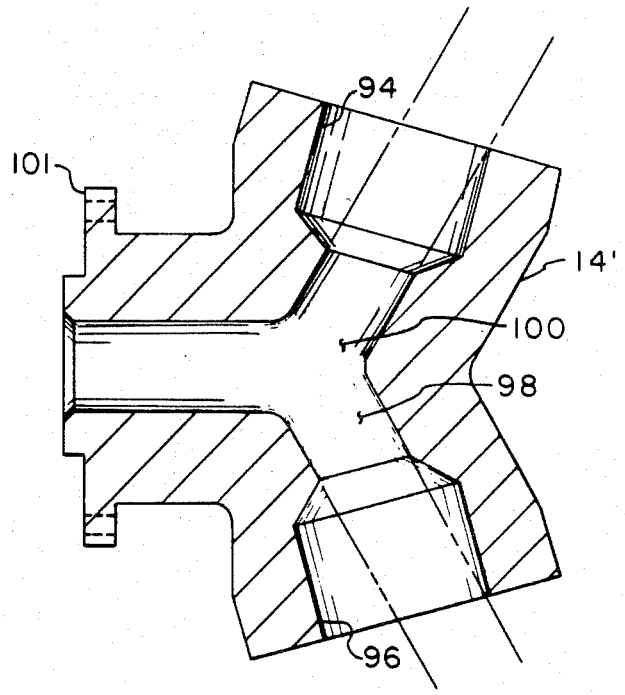
FIG. 7 is a schematic illustration similar to FIG. 1 showing the degree of tilt of the valve counterbores according to one aspect of the present invention.

Finally, referring to FIGS. 1 and 7 in its final aspect, the present invention includes discharge and suction valves 90, 92 of conventional type mounted in counterbores 94, 96 which are tilted angularly to the maximum extend toward the vertical direction while still retaining the capability of machining suction and discharge passages 98, 100, respectively, by straight-line techniques. This feature is illustrated more clearly on FIG. 7 where an extension of the bounds of the suction and discharge passages shows their relationship to the tilted counterbores in which the valves are to be mounted. This latter feature is applicable to pumps having the passage for the displacement body aligned in either a generally horizontal or a generally vertical direction. Note that in the embodiment shown in FIG. 7 fluid end 14' has a flange 101 adapted to be bolted to the power frame (not shown).

Various other embodiments within the scope of the invention will be apparent to those skilled in the art and are included in the language of the following appended claims:

We claim:

1. In a pump, said pump including at least one reciprocable displacement body, a fluid end piece having a separate passage for receiving each displacement body slidably therein, the passage for each body being joined by suction and discharge passages, valve means in each of the suction and discharge manifold assemblies, each assembly including a manifold, a cover for said valve means, conduit connecting each cover to the manifold, and means for attaching each cover to said fluid end piece, the improvement in said pump which comprises:

at least one of said manifolds including a body comprising axially separated tubular-shaped portions, an elongated generally tubular-shaped section adapted to fit axially in the space between said body portions, fluid tight joint means joining opposite ends of said tubular section to said body portions, and means mounting said body portions in fixed position with respect to said fluid end, said joint means permitting axial rotation of said tubular section about the axis thereof to a storage position displaced from the fluid end piece for repair and replacement of the valve means.

2. The apparatus of claim 1 wherein said manifold includes a plurality of generally tubular sections mounted axially in-line, and said joint means comprises a plurality of separate gas-tight joints joining said sections together and to the manifold body portions, said joint means permitting independent rotation of each tubular section about the axis thereof.

* * * * *